US005080316A

United States Patent [19]

MacEwan

[11] Patent Number: 5,080,316

[45] Date of Patent: * Jan. 14, 1992

[54] PORTABLE VIEWING STAND

[75] Inventor: Neil MacEwan, Windsor, Canada

[73] Assignee: Patricia MacEwan, Windsor, Canada; a part interest

[ * ] Notice: The portion of the term of this patent subsequent to Feb. 12, 2008 has been disclaimed.

[21] Appl. No.: 630,564

[22] Filed: Dec. 20, 1990

Related U.S. Application Data

[63] Continuation-in-part of Ser. No. 463,402, Jan. 11, 1990, Pat. No. 4,991,812.

[30] Foreign Application Priority Data

Sep. 28, 1989 [CA] Canada ..... 614258

[51] Int. Cl.[5] ..... A47B 97/04

[52] U.S. Cl. ..... 248/459; 248/174

[58] Field of Search ..... 248/459, 460, 441.1, 248/174, 472, 463, 465; 206/214; 40/155

[56] References Cited

U.S. PATENT DOCUMENTS

| | | | |
|---|---|---|---|
| 889,863 | 6/1908 | Tzschachmann | 248/465 |
| 2,035,021 | 3/1936 | Pyle et al. | 248/459 X |
| 2,165,255 | 7/1939 | Hamilton | 248/455 |
| 2,222,665 | 11/1940 | Hoenigsberg . | |
| 2,490,356 | 12/1949 | Hummel | 248/460 X |
| 2,726,835 | 12/1955 | Hummel | 248/459 |
| 3,097,444 | 7/1963 | Steiner | 248/454 |
| 3,210,874 | 10/1965 | Nichols | 248/459 X |
| 3,226,863 | 1/1966 | Southard | 248/460 X |
| 3,410,516 | 11/1968 | Criswell | 248/459 |
| 3,794,284 | 2/1974 | Guenther | 248/441.1 |
| 4,105,182 | 8/1978 | Jacobson . | |
| 4,274,616 | 6/1981 | Radtke | 248/459 |
| 4,607,817 | 8/1986 | Aquino | 248/460 X |
| 4,709,895 | 12/1987 | Mardak | 248/460 |
| 4,722,504 | 2/1988 | Degenholtz | 248/459 |
| 4,750,283 | 6/1988 | Halpern | 248/459 |
| 4,991,812 | 2/1991 | MacEwan | 248/459 |

*Primary Examiner*—Ramon O. Ramirez
*Attorney, Agent, or Firm*—Leonard Bloom

[57] ABSTRACT

This invention relates to a portable, collapsible stand for supporting materials such as books, sheet materials and the like in a convenient position to be viewed by an individual.

10 Claims, 2 Drawing Sheets

PORTABLE VIEWING STAND

CROSS-REFERENCE TO RELATED APPLICATION

This is a continuation-in-part of application Ser. No. 463,402 filed Jan. 11th, 1990, now U.S. Pat. No. 4,991,812.

BACKGROUND OF THE INVENTION

This invention relates to a portable, collapsible stand for supporting materials such as books, sheet materials and the like in a convenient position to be viewed by an individual.

The prior art has provided a wide variety of bookrests, display stands and the like. Generally speaking these prior art devices have disadvantages in terms of undue complexity, cost and ease of use. Some are made up from several components which must first be assembled together, thus increasing overall costs. Others involve the use of folding panels with multiple tabs, flaps, scorelines and die cuts, again increasing costs and assembly time. Many designs require substantial storage space thus increasing storage, shipping and retailing costs.

SUMMARY OF THE INVENTION

A general object of the invention is to provide an improved low cost, high strength collapsible stand for reading materials which eliminates or at least alleviates the various disadvantages noted above in respect of the known prior art arrangements.

Accordingly the invention in one aspect provides a collapsible, portable, viewing stand comprising an elongated blank of semi-rigid material having therein a plurality of spaced parallel fold lines extending transversely of the blank to define multiple successive panels; one group of said panels being folded and arranged to provide an upwardly and rearwardly sloping frontal panel, a downwardly extending rearward panel connected thereto and a bottom panel; another group of panels being folded and arranged to provide a bracing panel extending between said frontal and rearward panels in a mid-height region of the stand to stabilize said frontal panel; and a still further group of said panels being folded and arranged in a predetermined folded condition to provide a stop means adjacent a lower portion of said frontal panel to provide a rest for a book or other material when located in juxtaposition to said frontal panel for viewing purposes.

In particular, the panels and their fold lines are arranged such that the folding of each panel relative to the others takes place all to one side or major face of the blank. This assists in keeping manufacturing costs relatively low as described in further detail hereafter.

In a further aspect the invention provides a blank from stiff paperboard or equivalent having spaced parallel fold lines for use in the stand referred to above.

Other aspects and advantages of the invention will be apparent from the following description of a preferred embodiment of the invention, reference being had to the drawings.

DETAILED DESCRIPTION OF PREFERRED EMBODIMENT

Figure 3:
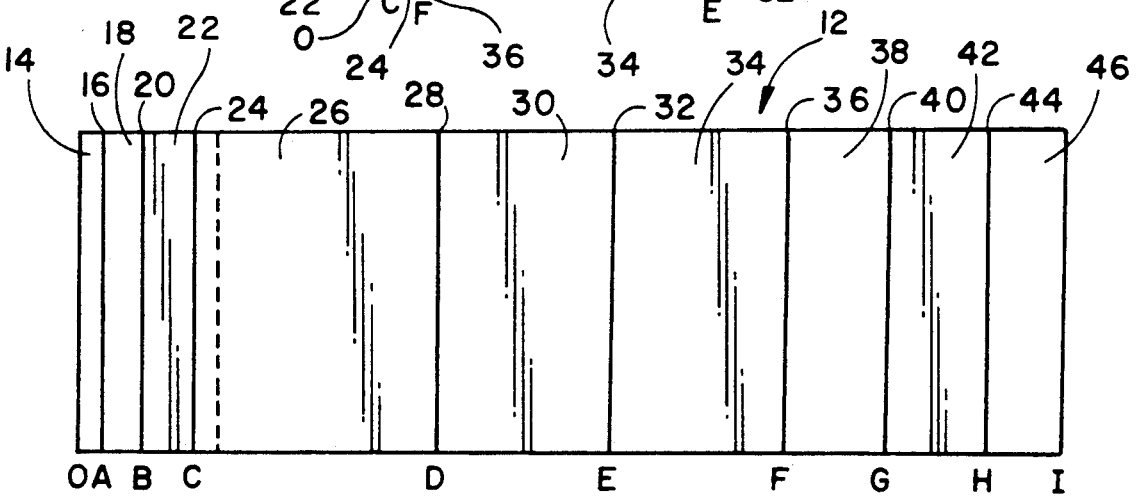
FIG. 3 is a plan view of the blank from which the stand is made, showing the fold or crease lines.

Referring now to the drawings it will be seen that the viewing stand 10 comprises an elongated integral blank 12 of rectangular outline and made from a semi-rigid material, preferably strong paperboard (eg corrugated box board) although other materials such as semi-rigid plastic sheet could be used. As seen in FIG. 3 the blank 12 is provided with a series of spaced, parallel, transversely extending weakened or scored crease or fold lines 16–44, which lines are placed in the blank by the manufacturer using well known techniques. These fold lines 16–44 define the serially arranged rectangular panels 14–46 as shown.

In one example of the invention, which is illustrative and not limiting, the blank 12 had a width of 13 inches approximately and the various panels had the following approximate dimensions measured in the lengthwise direction of the blank

| Panel No. | Length | Panel No. | Length |
|---|---|---|---|
| 14 | 1 in. | 34 | 7 in. |
| 18 | 1½ in. | 38 | 4 in. |
| 22 | 2 in. | 42 | 4 in. |
| 26 | 10 in. | 46 | 3 in. |
| 30 | 7½ in. | | |

Figure 1:
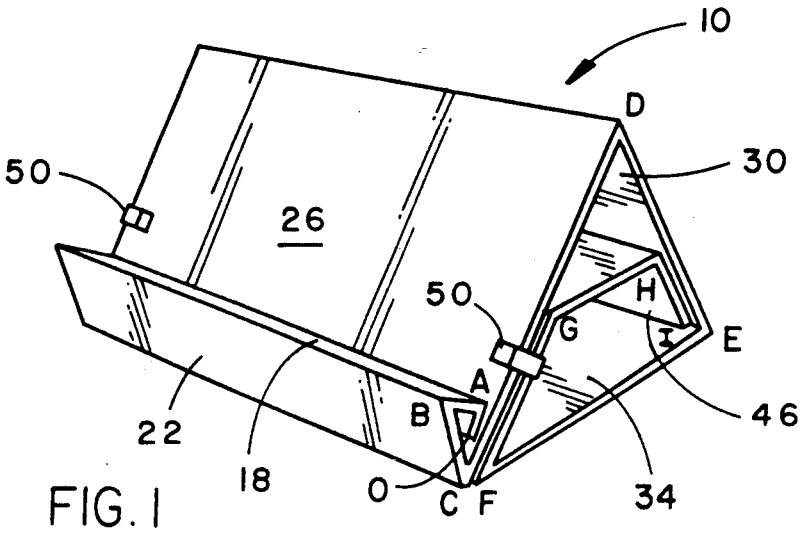
FIG. 1 is a perspective view of a portable, collapsible viewing stand in accordance with a preferred embodiment of the invention.
Figure 2:
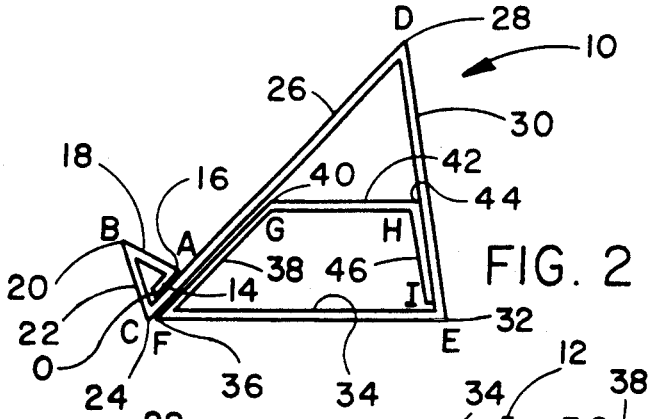
FIG. 2 is an end elevation view of the stand.

In the assembled condition shown in FIGS. 1 and 2 there is shown the upwardly, rearwardly sloping (eg about 50° to the horizontal) frontal panel 26. Rear panel 30 extends steeply downwardly from fold line 28 at the upper extremity of the frontal panel 26 and meets the horizontal bottom panel 34 at fold line 32. Bottom panel 34 extends forwardly to a position adjacent the lower extremity of the frontal panel 26. A first support panel 38 extends upwardly and rearwardly from fold line 36 at the forward extremity of the bottom panel in close juxtaposition to the rearward face of the frontal panel 26 until it reaches a mid-height position (ie at about one half the overall stand height). A bracing panel 42 thence extends generally parallel to bottom panel 34 rearwardly from fold line 40 at the upper extremity of panel 38 until it meets the forward face of rear panel 30. A further support panel 46 thence extends downwardly from fold line 44 until such panel meets the upper face of the bottom panel 34. Bracing panel 42 is thus held securely in position by the geometry of the configuration as shown and it helps to prevent buckling of the frontal panel 26 during use as well as defining a handy shelf for pencils, rulers, etc.

Simple U-shaped metal clips 50 (or other suitable fasteners as desired) at the margins of the assembly as seen in FIG. 1 secure the frontal panel 26 to support panel 38 and thus lock the above-described configuration in position. Panels 26, 30 and 34 define a triangular prism-like configuration thus assuring stability.

The remaining panels 14, 18 and 22 are folded about fold lines 16, 20 and 24 respectively into the triangular prism-like configuration shown as located at the lower portion of frontal panel 26 in close juxtaposition thereto to provide a stop or shelf to prevent a book or the like resting on the frontal panel 26 of the stand from sliding downwardly. A releasable adhesive (eg pressure sensitive type) or a "Velcro" type fastening material is applied to those surfaces of panels 26 and 14 which are in close juxtaposition to one another when assembled to thus secure them in that relationship. Alternate fasteners such as U-shaped metal clips similar to clips 50 could also be used.

Figure 5:
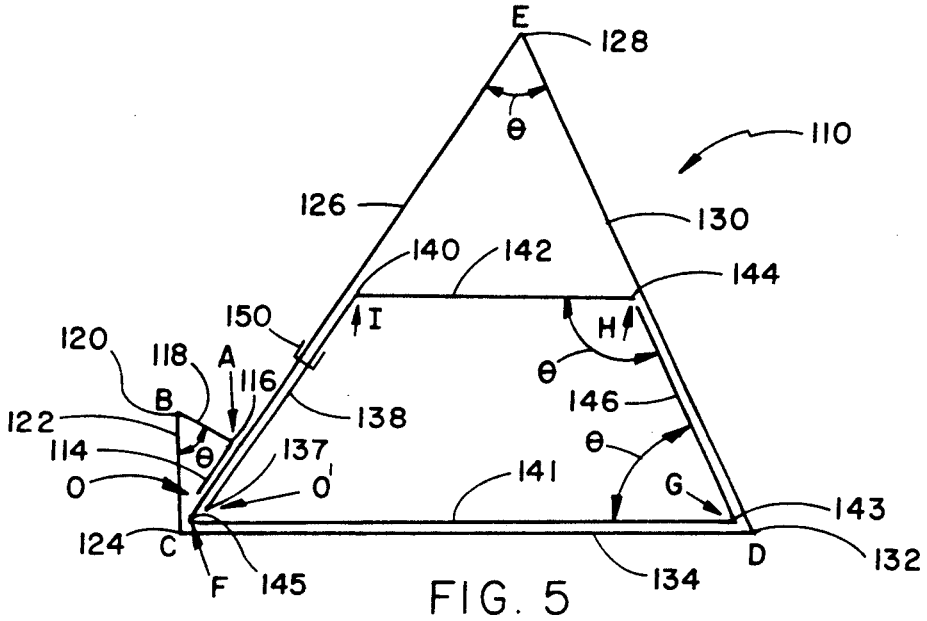
FIG. 5 is an end elevation view of a modified embodiment of the stand.
Figure 6:
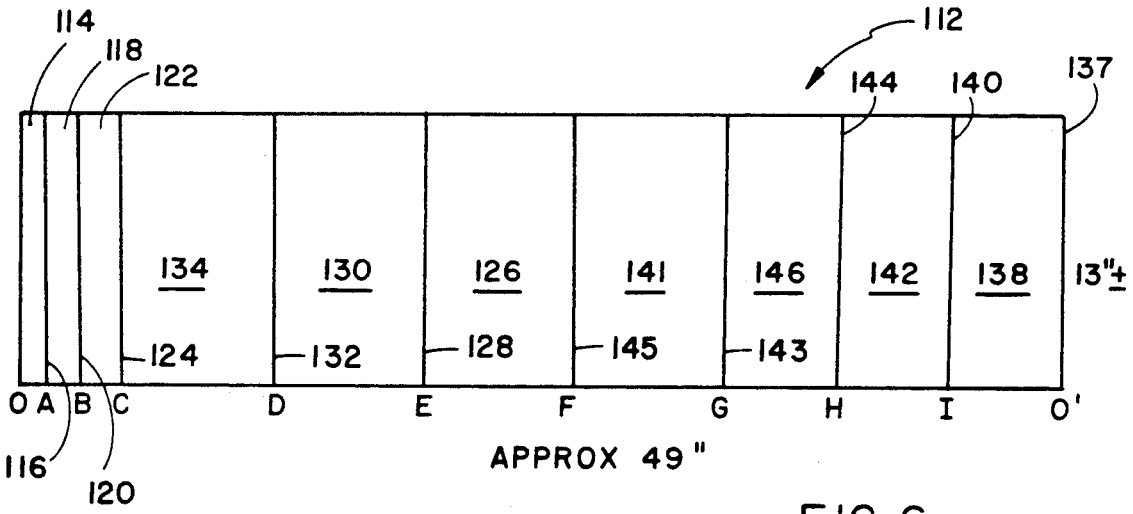
FIG. 6 is a plan view of the modified blank showing the fold lines.
Figure 7:
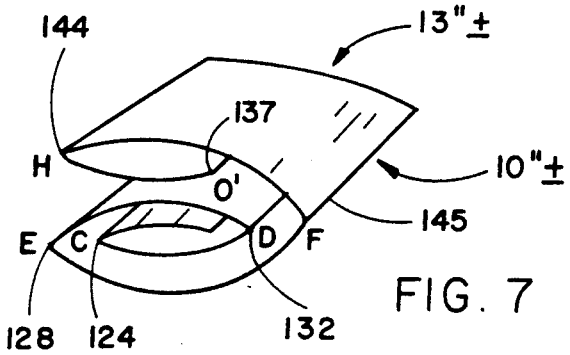
FIG. 7 is a view of the stand as collapsed for storage.

Referring now to FIGS. 5 through 7 it will be seen that the modified viewing stand 110 comprises an elongated integral blank 112 of rectangular outline and made as before from a semi-rigid material, preferably strong paperboard (eg corrugated box board) although other materials such as semi-rigid plastic sheet could be used. As seen in FIG. 6 the blank 112 is provided with a series of spaced, parallel, transversely extending weakened or scored crease or fold lines 116–145, which lines are placed in the blank by the manufacturer using well known techniques. These fold lines 116–145 define the serially arranged rectangular panels 114–146 as shown.

In one example of the invention, which is illustrative and not limiting, the blank 12 had a width of 13 inches and a length of 49 inches approximately and the various panels were proportioned in length generally as illustrated in FIG. 5.

In the assembled condition shown in FIG. 5 there is shown the upwardly, rearwardly sloping (eg about 50° to the horizontal) frontal panel 126. Rear panel 130 extends steeply downwardly from fold line 128 at the upper extremity of the frontal panel 126 and meets the horizontal outer bottom panel 134 at fold line 132. Outer bottom panel 134 extends forwardly to a position adjacent the lower extremity of the frontal panel 126. A frontal support panel 138 extends upwardly and rearwardly from free edge 137 adjacent the forward extremity of the outer bottom panel 134 in close juxtaposition to the rearward face of the frontal panel 126 until it reaches a mid-height position (ie at about one half the overall stand height). A bracing panel 142 thence extends generally parallel to outer bottom panel 134 rearwardly from fold line 140 at the upper extremity of panel 138 until it meets the forward face of rear panel 130. A rear support panel 146 thence extends downwardly from fold line 144 until such panel joins the inner bottom panel 141 at fold line 143, the inner bottom panel 141 joining the lower edge of frontal panel 126 at fold line 145. Bracing panel 142 is thus held securely in position by the geometry of the configuration as shown and it helps to prevent buckling of the frontal panel 126 during use as well as defining a handy shelf for pencils, rulers, etc.

Simple U-shaped metal clips 150 (or other suitable fasteners as previously desired) at the margins of the assembly as seen in FIG. 5 secure the frontal panel 126 to support panel 138 and thus lock the above-described configuration in position. Panels 126, 130, 134, and 141 define a triangular prism-like configuration thus assuring stability.

The remaining panels 114, 118 and 122 are folded about fold lines 116, 120 and 124 respectively into the triangular prism-like configuration shown as located at the lower portion of frontal panel 126 to provide a stop or shelf to prevent a book or the like resting on the frontal panel 126 of the stand from sliding downwardly. Panel 122 is connected to the frontal edge of outer bottom panel at fold line 124. A releasable adhesive (eg pressure sensitive type) or a "Velcro" type fastening material is applied to those surfaces of panels 126 and 114 which are in close juxtaposition to one another when assembled to thus secure them in that relationship. Alternate fasteners such as U-shaped metal clips similar to clips 150 could also be used.

A notable feature, and a major reason for the particular fold and panel arrangement of the modified embodiment of FIGS. 5–7, is that the folding of the panels relative to one another to produce the folded configurations of FIGS. 5 and 7 is all in the same direction, i.e. to one side or major face of the blank. In other words, the arcs $\theta$ (a few of which are shown in FIG.5) through which the panels rotate as they are folded relative to one another all lie to one major face only of the blank. This has advantages in respect of the procedure used for applying the crease lines to the blank. The crease lines, especially for paperboard, are formed in accordance with the fold direction, as is well known. By having the folds all in the same direction, the blank need only be passed through the creasing machine once. If the folds are in both directions, as in the first embodiment, the blank must be passed twice through the machine, one pass for each crease direction. The cost savings inherent in the second embodiment will be appreciated by those skilled in this art even though a slightly greater amount of material, represented by the second bottom panel, is required.

Figure 4:
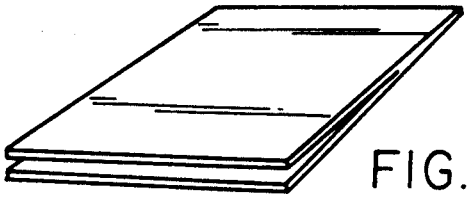
FIG. 4 is a perspective view of the stand in the collapsed storage position.

The stands as described occupy little space in the collapsed conditions shown in FIGS. 4 and 7 thus saving storage space and being of benefit to manufacturers, retailers and users eg. students who will wish to collapse the stands and store them over extended periods eg. during summer holidays.

The blank may be made from standard paperboard stock thus keeping costs to a minimum. Thus the final selling price may be made sufficiently low as to be attractive to students and others while allowing reasonable profit margins for manufacturers, retailers etc. The major panels of the stand may be imprinted with logos, advertizing material and the like thus enhancing the value of the product for merchants. Numerous other advantages will be apparent to those skilled in this art.

I claim:

1. A collapsible, portable, viewing stand comprising: an elongated blank of semi-rigid material having a pair of opposed major faces and the blank having therein a plurality of spaced parallel fold lines extending transversely of the blank to define multiple successive panels; one group of said panels being folded and arranged to provide an upwardly and rearwardly sloping frontal panel, a downwardly extending rearward panel connected thereto and a bottom panel; another group of panels being folded and arranged to provide a bracing panel extending between said frontal and rearward panels in a mid-height region of the stand to stabilize said frontal panel; a still further group of said panels being folded and arranged in a predetermined folded condition to provide a stop means adjacent a lower portion of said frontal panel to provide a rest for a book or other material when located in juxtaposition to said frontal panel for viewing purposes, and wherein said fold lines and the panels defined thereby are further arranged such that the arcs through which said panels must be rotated as they are folded relative to one another to provide the viewing stand all lie to only one of said major faces of the panel.

2. The stand of claim 1 wherein said blank is integral or unitary, having a generally rectangular outline configuration.

3. The stand of claim 2 wherein said frontal, rearward and bottom panels together define a triangular prism-like array and said bracing panel extends in approximate parallelism to said bottom panel, and means joining selected ones of said panels together to maintain the panels in their respective folded positions.

4. A collapsible portable viewing stand comprising: an elongated integral blank of semi-rigid material having a pair of opposed major faces, the blank being weakened or scored along a plurality of spaced parallel fold lines extending transversely of the blank to define multiple successive panels lengthwise of the blank; a first group of said panels defining, in the erected, folded condition of the stand, an upwardly and rearwardly sloping frontal panel, a rear panel extending steeply downwardly extending from an upper extremity of the frontal panel, a bottom panel extending forwardly from a lower extremity of the rear panel to a position adjacent a lower extremity of said frontal panel, a first support panel extending from a position adjacent a forward extremity of said bottom panel upwardly and rearwardly in close juxtaposition to a rearward face of said frontal panel to a generally mid-height position of the stand, a bracing panel extending from an upper extremity of said first support panel rearwardly into juxtaposition to a forward face of said rear panel, and a further support panel extending from a rearward extremity of said bracing panel generally downwardly in close juxtaposition to the forward face of said rear panel to a position adjacent a rearward extremity of said bottom panel; and a second group of said panels being so folded as to define a stop adjacent a lower portion of said frontal panel against which a book or other material may rest when located or positioned over said frontal panel for viewing purposes, and wherein said fold lines and the panels defined thereby are further arranged such that the arcs through which said panels must be rotated as they are folded to provide an erected stand all lie to only one of said major faces of the panel.

5. The stand according to claim 4 wherein said second group of panels comprise three panels folded to define a triangular prism-like shape thereby to form said stop, and the blank having a rectangular outline shape.

6. The stand of claim 5 wherein said second group of panels defines one end portion of said blank.

7. The stand of claim 4 including attachment means for securing said first support panel to said frontal panel.

8. The stand of claim 4 including attachment means for securing said first support panel to said frontal panel and for securing said panels of the second group in the folded position to define said stop.

9. A blank capable of forming a collapsible, portable, viewing stand, said blank having a pair of opposed major faces and comprising: an elongated sheet of semi-rigid material having therein a plurality of parallel fold lines extending transversely of the blank with the fold lines being spaced apart in the lengthwise direction of the blank to define multiple successive rectangular panels; one group of successive said panels being dimensioned so that they can be folded about their associated fold lines and arranged to provide an upwardly and rearwardly sloping frontal panel, a downwardly extending rearward panel and a bottom panel; another group of successive said panels being dimensioned such that they can be folded and arranged to provide a bracing panel of the same width as the frontal and rearward panels extending between said frontal and rearward panels in a mid-height region of the stand to stabilize said frontal panel; and a still further group of successive said panels being dimensioned to enable them to be folded and arranged in a predetermined folded condition to provide a stop means adjacent a lower portion of said frontal panel to provide a rest for a book or other material when located in juxtaposition to said frontal panel for viewing purposes, and wherein said fold lines and the panels defined thereby are further arranged such that the arcs through which said panels must be rotated as they are folded relative to one another to provide the viewing stand all lie to only one of said major faces of the panel.

10. The blank of claim 9 wherein said elongated sheet is integral or unitary, having a generally rectangular outline configuration overall.

* * * * *